US005899267A

United States Patent [19]

Kroetsch et al.

[11] Patent Number: 5,899,267

[45] Date of Patent: May 4, 1999

[54] HEAT EXCHANGER SEALED TANK AND HEADER ASSEMBLY WITH GASKET DISPLACEMENT PREVENTION

[75] Inventors: Karl Paul Kroetsch, Williamsville; Jeffrey Leo Minner, Lockport, both of N.Y.

[73] Assignee: General Motors Corporation, Detroit, Mich.

[21] Appl. No.: 09/152,808

[22] Filed: Sep. 14, 1998

[51] Int. Cl.[6] ..... F28F 9/02

[52] U.S. Cl. ..... 165/173; 277/638; 165/DIG. 474

[58] Field of Search ..... 165/173; 277/611, 277/638

[56] References Cited

U.S. PATENT DOCUMENTS

| | | | |
|---|---|---|---|
| 2,783,295 | 2/1957 | Ewing | 277/611 |
| 4,401,157 | 8/1983 | Cadars | 165/173 |
| 4,917,035 | 4/1990 | Beamer | 165/173 |
| 4,997,035 | 3/1991 | Beatenbough et al. | 165/173 |
| 5,201,368 | 4/1993 | Kroetsch | 165/173 |

FOREIGN PATENT DOCUMENTS

| | | | |
|---|---|---|---|
| 372187 | 6/1990 | European Pat. Off. | 165/173 |
| 58-86394 | 5/1983 | Japan | 165/173 |
| 4-194593 | 7/1992 | Japan | 165/173 |

*Primary Examiner*—Allen Flanigan
*Attorney, Agent, or Firm*—Patrick M. Griffin

[57] ABSTRACT

A radiator tank of the type that has a perimeter foot clinched into a U shaped header plate channel to compress an elastomer seal is improved with a means to help assure that portions of the gasket that are displaced from beneath the foot at installation either do not create leak paths, or create leak paths that are static and easier to detect. Integrally molded discrete ribs above the bottom of the perimeter foot extend out and over the inner surface of the header plate, in a location where they can engage and pinch displaced portions of the gasket down against the header plate. Leaks are thereby either prevented, or, at least, the displaced and pinched down section of the gasket is held fast and prevented from moving in and out of the crevice between the tank foot and the channel under the influence of negative to positive pressure variations in the coolant. This makes leak detection easier, because the leak is static and consistent.

3 Claims, 5 Drawing Sheets

HEAT EXCHANGER SEALED TANK AND HEADER ASSEMBLY WITH GASKET DISPLACEMENT PREVENTION

TECHNICAL FIELD

This invention relates to gasket sealed heat exchanger tank and header assemblies in general, and specifically to such an assembly that is improved by the addition of a means to prevent or limit displacement of the sealing gasket.

BACKGROUND OF THE INVENTION

Heat exchangers, especially automotive radiators, typically include a coolant tank that relies upon an elastomer gasket for a fluid tight seal. Displacement of the gasket during or after installation threatens the integrity of the seal, and the leaks caused thereby can have a dynamic aspect that makes the leak difficult to detect.

An example may be seen in the attached FIGS. 1 through 7. An open sided, molded plastic tank, indicated generally at 10, has a four sided outer wall 12 the bottom edge of which is integrally molded with a thickened perimeter foot 14. A slotted aluminum tube header plate, indicated generally at 16, is stamped with an integral, four sided, U shaped perimeter channel 18. The inner surface of the channel 18 merges into the inner surface of the header plate 16 across a curved, generally right angle bend. The outer edge of the U shaped channel 18 includes a plurality of clinch tabs 20, which are ultimately crimped down over the top of the foot 14, as seen in FIG. 3. Foot 14 is deliberately less wide than the channel 18, so as to fit within it without binding, leaving slight gaps relative to the side surfaces of the channel 18. Since the inner surface of the tank outer wall 12 diverges sharply from the inner surface of the header plate 16 (at essentially a right angle) it forms an open, divergent, perimeter crevice C running from beneath the tank foot 14 to the interior of the tank 10.

The purpose of crimping foot 14 within channel 18, besides attaching the tank 10, is to compress a continuous elastomer seal gasket 22, which is first fitted down into channel 18, as best seen in FIG. 1. When the gasket 22 is clinched beneath the foot 14, a continuous perimeter seal is created so that fluid cannot leak through the crevice C and out, as seen in FIG. 4. A not previously well recognized problem is the potential for gasket 22 to be misplaced before the clinch operation is completed, creating a potential leak path. As best seen in FIGS. 2 and 5, the gasket 22 is relatively long, and is subject to not being fully seated within channel 18, particularly at the corners, where it can ride up over the curved corner of the header plate 16-channel 18 transition. Then, as seen in FIG. 6, after the clinch operation, a portion of the gasket 22 can be squeezed and compressed within the crevice C, rather than being properly compressed down beneath the foot 14. This may not create a leak, so long as the coolant in the interior of the tank 12 is under a positive pressure, as it generally is during vehicle radiator operation. This is indicated by the arrows in FIG. 6, representative of positive pressure acting to press the displaced portion of gasket 22 back down into the crevice C. However, during the radiator coolant fill operation at the assembly plant, the radiator tanks are subjected to negative pressure, the so called vacuum fill operation. This puts the gasket 22 under a negative pressure, indicated by the reversed arrows in FIG. 7, which can pull the displaced portion thereof further, or completely, out of the crevice C, opening a potential leak path. However, the leak may disappear later, after a short period of positive pressure, and such leaks can ultimately prove very elusive and difficult to detect.

The crevice generally indicated at C has found mention in the prior art, but not in the context of gasket leak creation and detection just noted. Rather, a different problem of corrosion created by stagnant coolant resting in the crevice has been noted, and various techniques for its prevention proposed. Most often, this takes the form of integrally molded flanges added to the gasket 22, which fill up the crevice C and keep stagnant coolant out. In fact, such a flange is shown on gasket 22, and is described in coassigned U.S. Pat. No. 5,201,368, as well as a similar design disclosed in coassigned U.S. Pat. No. 5 4,917,182. However, the efficacy of such a design presupposes proper and complete gasket placement, and does nothing to deal with the elusive leak potential just noted. Another known design proposes stand off ribs molded to the rear surface of the tank foot within the U shaped channel, and apparently intended to hold the inner surface of the tank wall consistently away from the inner surface of the channel. This keeps the crevice open wide, in effect, and is claimed to somehow promote mixing of the coolant within the crevice to prevent stagnation and corrosion. The ribs disclosed are flush to the inner surface of the tank outer wall, and fit within the U shaped channel in line with the inner surface of the U shaped channel. They would do little or nothing to prevent the kind of dynamic gasket displacement and leakage noted above, and are not intended or designed to do so.

SUMMARY OF THE INVENTION

The invention provides a modification to a tank of the type described that does prevent gasket leaks due to all but the most severe gasket displacements.

In the embodiment disclosed, the plastic tank is integrally molded with a plurality of discrete crevice blocking ribs overlaying those areas of the gasket that are especially prone to displacement, such as the ends and corners. The ribs extend out from the inner surface of the tank outer wall, rather than flushed thereto, and extend out over the crevice, spaced slightly above the inner surface of the header plate where it transitions into the U shaped channel. There is enough space between the bottom of the ribs and the header plate for the ribs to catch and compress the displaced portion of the gasket against the header plate when the tank foot is crimped into the channel. This has the effect of pinching the displaced portion of the gasket and holding it still, but without pushing the tank foot so far up and out of the U shaped channel to prevent the tabs from being successfully clinched down over the foot.

In operation, or during coolant fill, the compressed displaced portion of the gasket is thereby prevented from being pulled in and out of crevice with pressure variations. For minor gasket displacements, leaks are prevented, while with more severe displacements, the attendant leaks are stable and easier to consistently detect.

BRIEF DESCRIPTION OF THE DRAWINGS

These and other features of the invention will appear from the following written description, and from the drawings, in which.

DESCRIPTION OF THE PREFERRED EMBODIMENT

Figure 1:
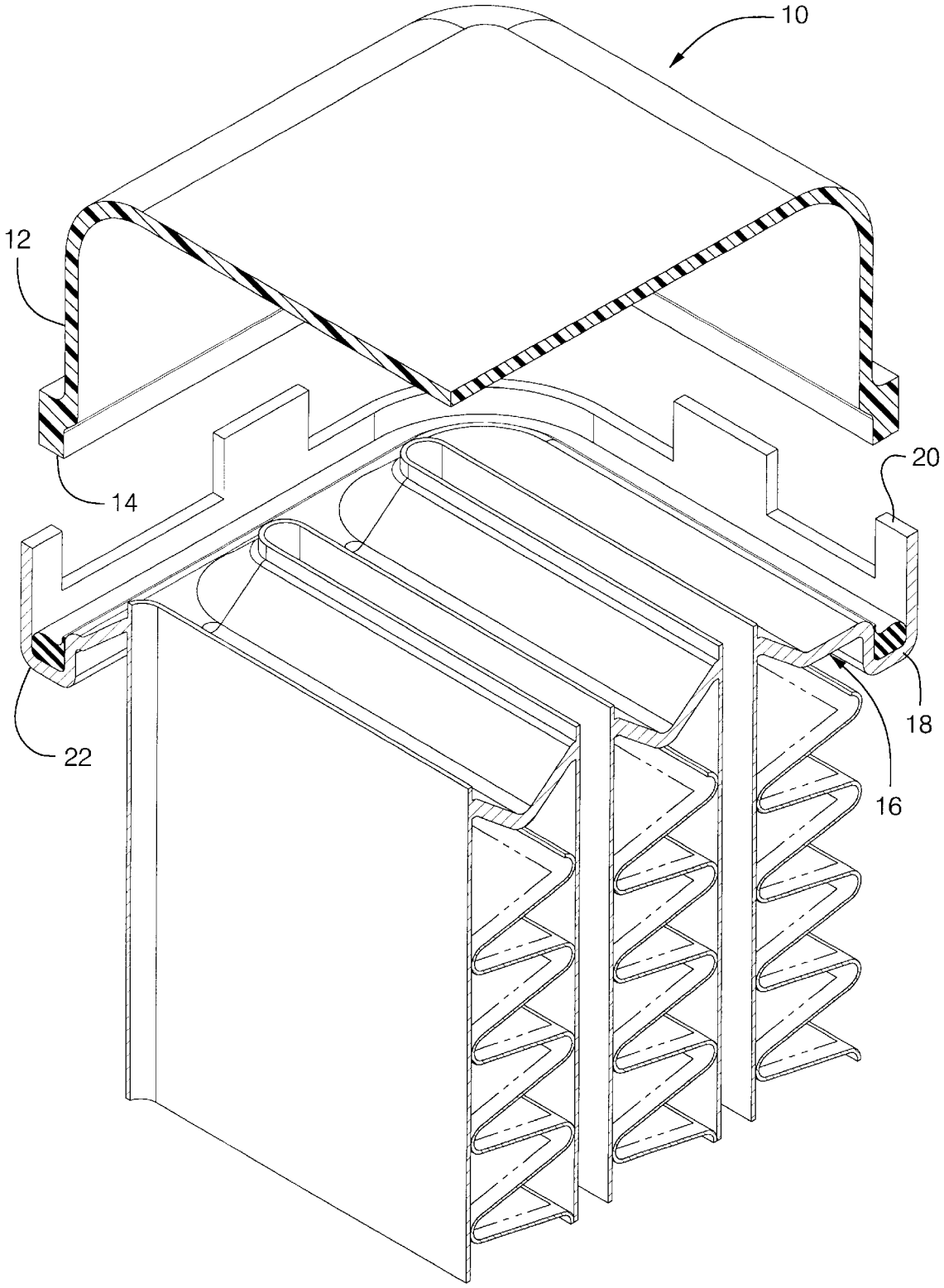
PRIOR ART FIG. 1
FIG. 1 is a perspective view of a corner end of a prior art plastic molded tank and radiator core header plate.
Figure 2:
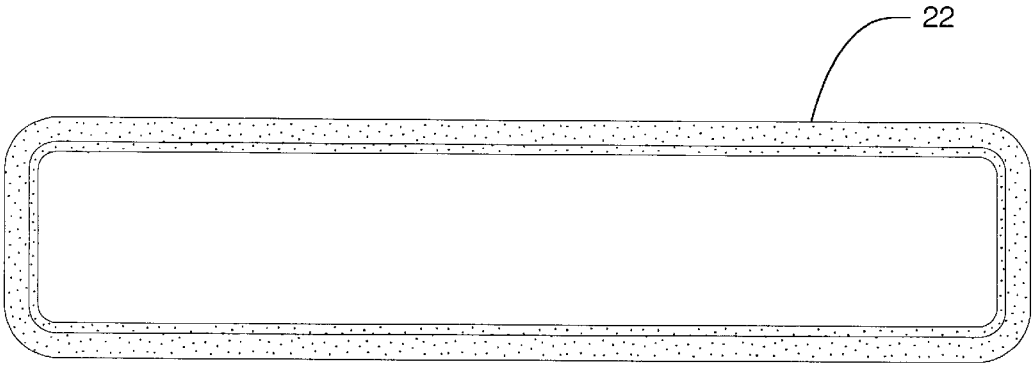
PRIOR ART FIG. 2
FIG. 2 is a plan view of a typical molded elastomer seal gasket.
Figure 3:
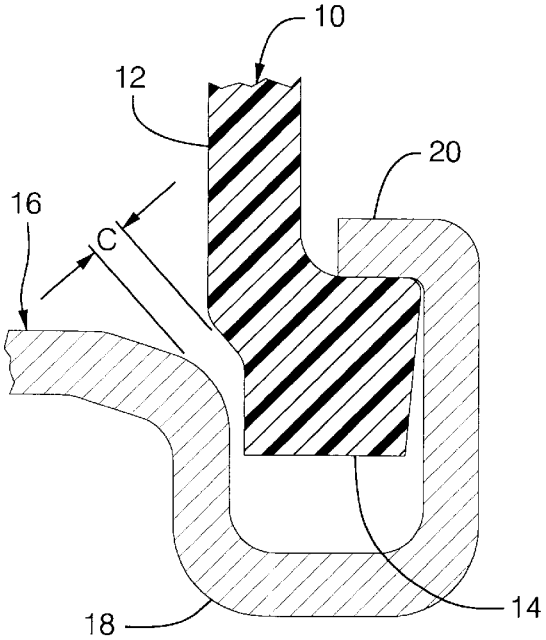
PRIOR ART FIG. 3
FIG. 3 is a cross section through a prior art tank foot clinched into a header plate channel, without the gasket in place.
Figure 4:
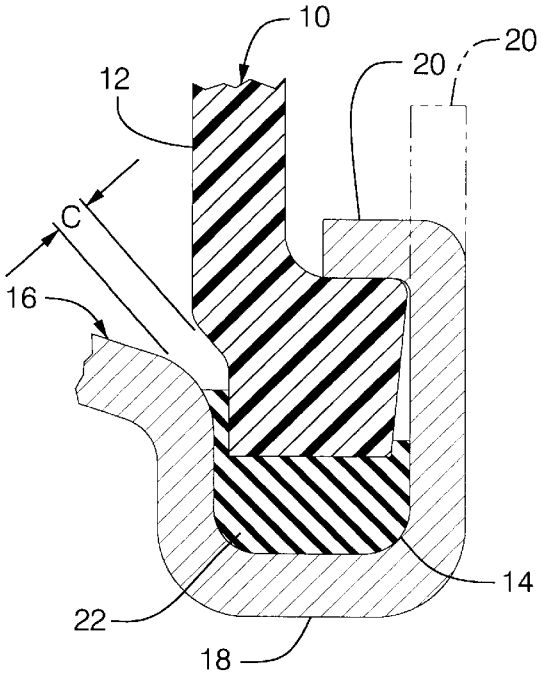
PRIOR ART FIG. 4
FIG. 4 shows the same structure as FIG. 3, but with the gasket installed and properly seated.
Figure 5:
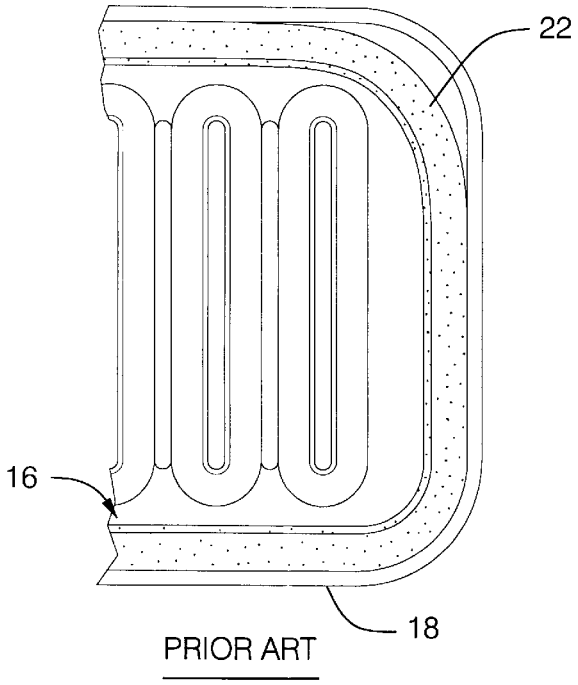
PRIOR ART FIG. 5
FIG. 5 is a plan view of the header plate channel with a portion of the gasket displaced.
Figure 6:
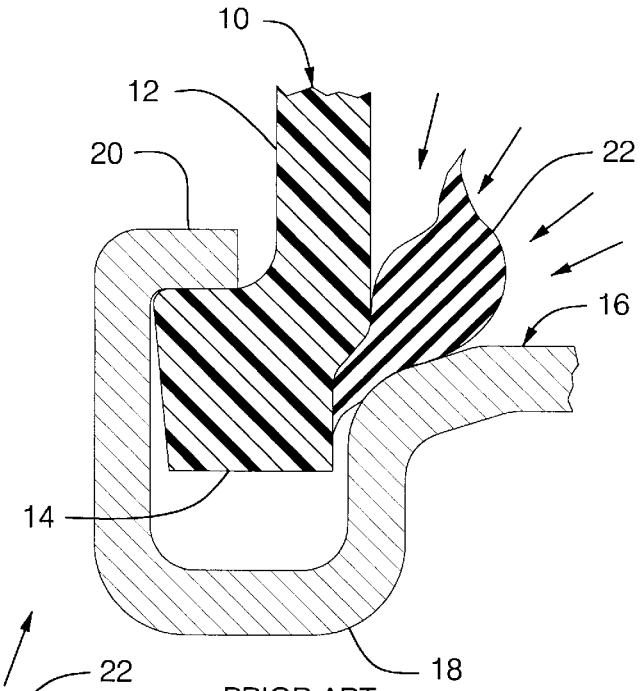
PRIOR ART FIG. 6
FIG. 6 is a cross section taken through the tank foot and channel at the displaced portion of the gasket, under positive pressure.
Figure 7:
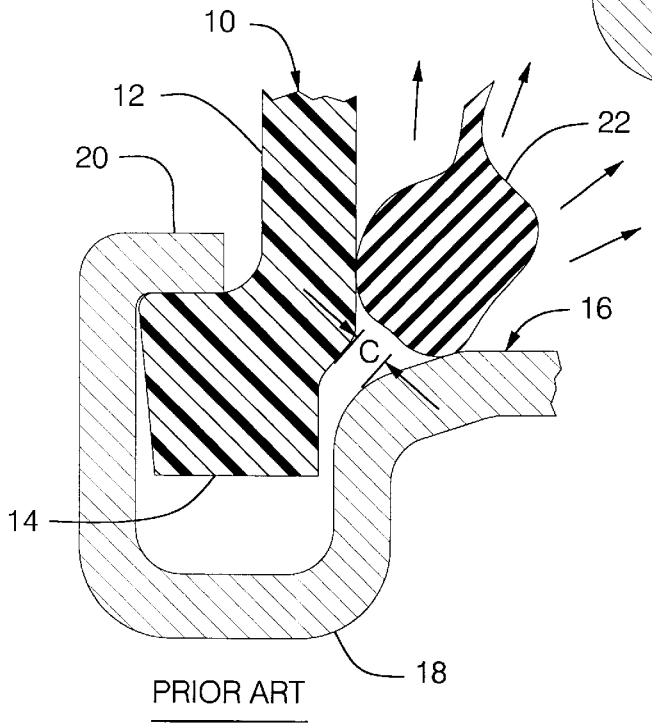
PRIOR ART FIG. 7
FIG. 7 is the same portion of the gasket under negative pressure.
Figure 8:
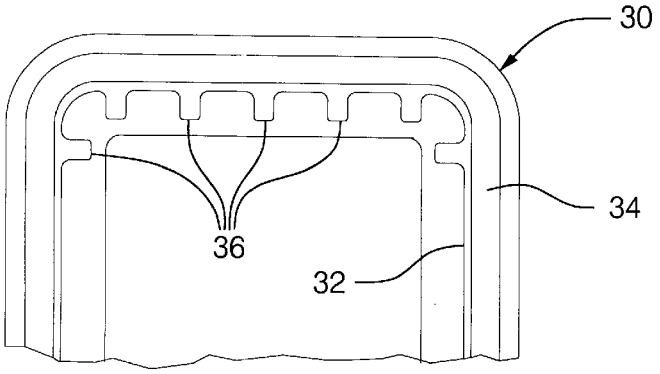
FIG. 8 is a plan view of the inside of a preferred embodiment of a tank made according to the invention, showing the crevice blocking ribs.
Figure 9:
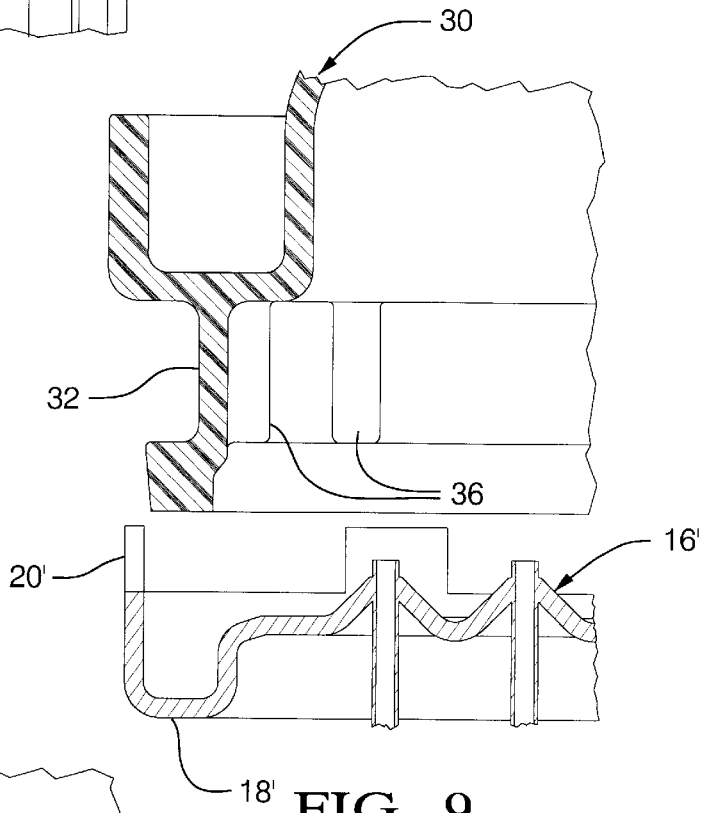
FIG. 9 is a cross section through the tank foot and channel prior to the crimping operation.

Referring first to FIGS. 7 and 8, a preferred embodiment of a tank made according to the invention is indicated generally at 30. Tank 30 is similar to tank 10, in terms of size, shape and material. It also has an outside wall 32 with a bottom edge consisting of a slightly offset, thickened foot 34, similar in size and shape to foot 14. In addition, however, a plurality of discrete, inwardly extending crevice blocking ribs 36 are integrally molded integrally off the inner surface of outside wall 32, just above the foot 34. The ribs 36 are concentrated at the end and corner of the wall 32, corresponding to those areas where gasket displacement is most likely, as described above. The header plate and channel are essentially identical to that described above, and so are given the same number primed (′), and not further described.

Figure 10:
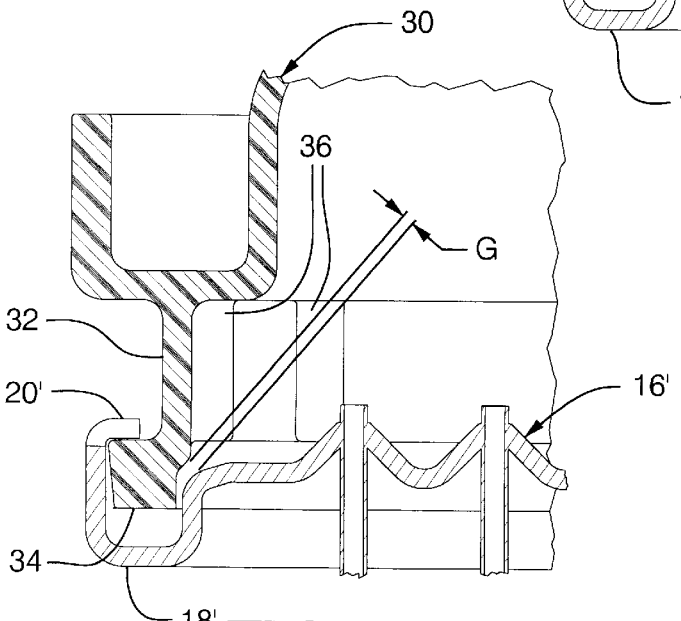
FIG. 10 shows the same structures as FIG. 9 after crimping, but without the gasket installed.

Referring next to FIG. 10, the tank 30 is shown attached to the header plate 16′ without a gasket, which would never be done in practice, but which serves to better illustrate some structural inter relationships. (The gasket that would be used would be the same as gasket 22 described above, however, also given the same number with a prime). Tank foot 34 is crimped under the clinch tabs 20′, creating the same crevice C. Now, however, crevice C is overlain by the ribs 36, which also extend inwardly over the inner surface of header plate 16′, at the area of transition to the inner surface of the channel 18′. Again, this is the area where gasket displacement is likely, near the corners and ends of tank 30. The bottom of the ribs 36 do not directly touch the inner surface of header plate 16′, however, but leave a small gap G, for purposes described below.

Figure 11:
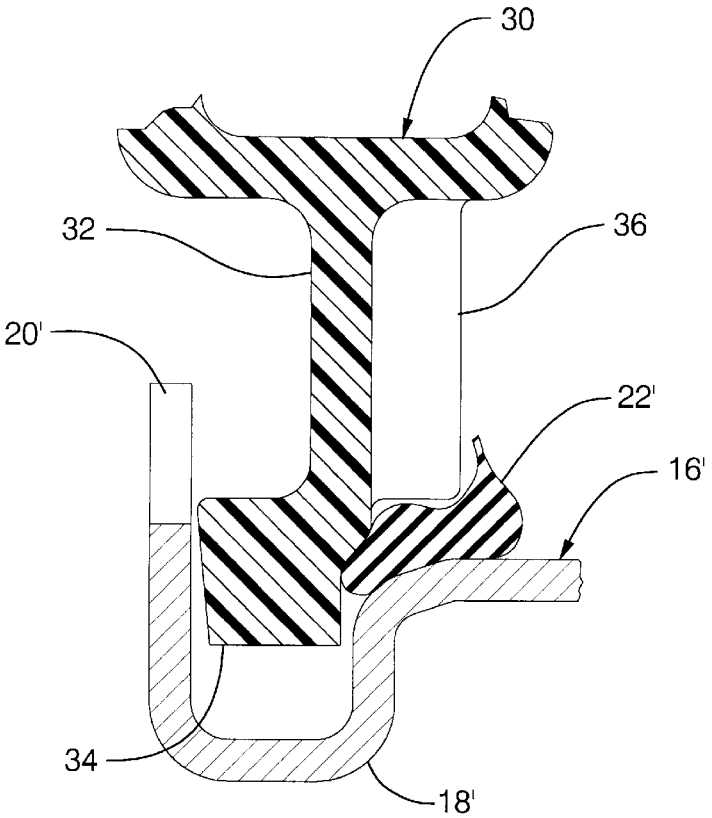
FIG. 11 shows the tank foot in place, with the ribs overlaying a displaced portion of the gasket, prior to the crimping operation.
Figure 12:
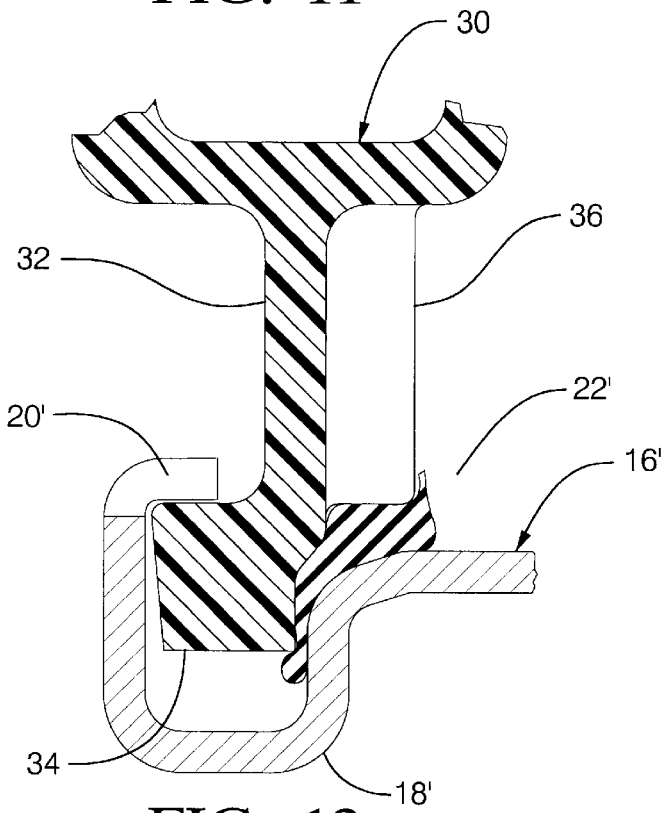
FIG. 12 shows the displaced portion of the gasket compressed and retained after the crimping operation.

Referring next to FIGS. 11 and 12, the situation where a portion of the gasket 22′ is displaced below the ribs 36 is illustrated. Prior to the clinching operation, the displaced section of the gasket 22 lies uncompressed below the ribs 36, resting within the gap G just described above. As seen in FIG. 12, after the clinch operation, the bottom of the ribs 36 pinch the displaced section of the gasket 22′ against the inner surface of the header plate 16′, compressed down to approximately the thickness of the gap G. The gap G is deliberately made large enough, relative to the thickness of the gasket 22′, so that compression of any part of gasket 22′ below the ribs 36 will not in fact jeopardize the ability of the tabs 20′ to be bent down and over the top of tank perimeter foot 34. While the mislocation of the displaced section of the gasket 22′ is not prevented or cured, nor is it flagged by an inability to complete the clinch operation, it is at least limited and held stationary within the crevice C beneath the ribs 36. This is an advantage for several reasons. First, relatively minor displacements of the gasket 22′ will not cause a leak at all, because the ribs 36 will compress it enough to maintain a seal at the affected region. Just as important, the stationary retention of the displaced gasket section will prevent the kind of on again-off again leak caused by pressure cycling as described above. Second, there may be gasket displacements so severe that a leak will occur at the points where the gasket transitions from the pinched section beneath the ribs 36 and back down to the remainder that is properly seated beneath the tank foot 34 in the channel 18′. In such case, the leak that occurs at the transition point will at least be constant, and not temporarily masked by a negative pressure acting to push the displaced gasket section back down into the crevice C, as occurs when the displaced gasket section can float freely.

Variations in the embodiment disclosed could be made. As noted, the ribs 36 could be located anywhere that a potential gasket displacement could be expected. That will vary over different tank, header plate, and gasket designs. As disclosed, the crevice blocking structure used is a series of discrete ribs, rather than a single, solid, continuous flange, shelf or the like. Such an alternate structure, extending out over the crevice and over the inner surface of the header plate in the area where gasket displacement was likely, would serve the same basic function of compressing and holding stationary the displaced section of the gasket. However, it is thought that the discrete, spaced apart ribs 36 are advantageous in that they provide interstitial room to accommodate the compressed portion of the gasket, which can bulge up, rather than being squeezed out and down. The gap G thickness would be varied from case to case, depending on the thickness of the particular gasket to be accommodated. Theoretically, a very small or even non existent gap G could displace the tank foot so far as to actually prevent tank clinching, thereby flagging that the gasket was in fact severely displaced. Accordingly, the scope of this invention is to be considered limited only by the following claims.

We claim:

1. In a heat exchanger of the type having a tank sealed to a header plate, and in which the tank includes a perimeter foot forming the bottom edge of an outside wall which is crimped into a substantially U shaped perimeter channel surrounding the header plate to compress an elastomer gasket seal into the U shaped channel beneath the perimeter foot, with the inner surface of the tank outside wall generally aligned with the inner surface of the U shaped channel and diverging from the inner surface of the header plate to create a perimeter crevice opening into the tank interior, the improvement comprising, a crevice blocking structure extending from the inner surface of the tank outside wall over the crevice and overlaying the header plate, whereby any adjacent portion of the gasket displaced from beneath the perimeter foot and into the crevice will be compressed against the inner surface of the header plate by the crevice blocking structure.

2. In a heat exchanger of the type having a tank sealed to a header plate, and in which the tank includes a perimeter foot forming the bottom edge of an outside wall which is crimped into a substantially U shaped perimeter channel surrounding the header plate to compress an elastomer gasket seal into the U shaped channel beneath the perimeter foot, with the inner surface of the tank outside wall generally aligned with the inner surface of the U shaped channel and diverging from the inner surface of the header plate to create a perimeter crevice opening into the tank interior, the improvement comprising, a plurality of discrete crevice blocking ribs extending from the inner surface of the tank outside wall over the crevice and overlaying the header plate, whereby any adjacent portion of the gasket displaced from beneath the perimeter foot and into the crevice will be compressed against the inner surface of the header plate by the blocking ribs and thereby prevented from moving farther into the tank interior.

3. In a heat exchanger of the type having a tank sealed to a header plate, and in which the tank includes a perimeter foot forming the bottom edge of an outside wall which is crimped into a substantially U shaped perimeter channel surrounding the header plate to compress an elastomer gasket seal into the U shaped channel beneath the perimeter foot, with the inner surface of the tank outside wall generally aligned with the inner surface of the U shaped channel and diverging from the inner surface of the header plate to create a perimeter crevice opening into the tank interior, the improvement comprising, a plurality of discrete crevice blocking ribs extending from the inner surface of the tank outside wall over the crevice and overlaying the header plate and spaced therefrom by a gap, whereby any adjacent portion of the gasket displaced from beneath the perimeter foot and into the crevice will be compressed within said gap against the inner surface of the header plate by the blocking ribs and thereby prevented from moving farther into the tank interior.

* * * * *